United States Patent [19]

Irwin et al.

[11] Patent Number: 4,722,709

[45] Date of Patent: Feb. 2, 1988

[54] MARINE PROPULSION DEVICE COWL ASSEMBLY

[75] Inventors: Gregory D. Irwin, Lindenhurst; Robert W. Woodard, Waukegan, both of Ill.

[73] Assignee: Outboard Marine Corporation, Waukegan, Ill.

[21] Appl. No.: 799,605

[22] Filed: Nov. 19, 1985

[51] Int. Cl.[4] ..... B63H 21/24

[52] U.S. Cl. ..... 440/89

[58] Field of Search ..... 440/77, 88, 89; 181/229, 35; 123/198 E, 195 P, 195 C

[56] References Cited

U.S. PATENT DOCUMENTS

| | | | |
|---|---|---|---|
| 2,224,900 | 12/1940 | Conover | 440/88 |
| 2,798,470 | 7/1957 | Kiekhaefer | 123/198 |
| 2,815,742 | 12/1957 | Kiekhaefer | 123/198 |
| 2,839,042 | 6/1955 | Armstrong et al. | 123/198 |
| 2,914,133 | 11/1959 | Johnson | 181/53 |
| 3,195,530 | 7/1962 | Heidner | 123/198 |
| 3,204,619 | 9/1962 | Rubinowitz et al. | 123/74 |
| 3,358,668 | 12/1967 | Post et al. | 123/198 |
| 3,557,902 | 1/1971 | Brown et al. | 181/35 |
| 3,610,198 | 10/1971 | Alexandrowicz | 115/17 |
| 3,712,416 | 1/1973 | Swanson et al. | 181/35 |
| 4,016,825 | 4/1977 | Pichl | 440/88 |
| 4,136,756 | 1/1979 | Kawamura | 181/229 |
| 4,326,600 | 4/1982 | Okazaki et al. | 440/88 |
| 4,348,194 | 9/1982 | Walsh | 440/77 |
| 4,379,702 | 4/1983 | Takada et al. | 440/77 |
| 4,403,971 | 9/1983 | Kobayashi et al. | 440/88 |
| 4,493,661 | 1/1985 | Iwai | 440/77 |
| 4,522,602 | 6/1985 | Okazaki | 440/77 |

FOREIGN PATENT DOCUMENTS

| | | | |
|---|---|---|---|
| 57-41291 | 8/1982 | Japan | 440/77 |
| 57-26091 | 12/1982 | Japan | 440/77 |

*Primary Examiner*—Joseph F. Peters, Jr.
*Assistant Examiner*—Jesûs D. Sotelo
*Attorney, Agent, or Firm*—Michael, Best & Friedrich

[57] ABSTRACT

A marine propulsion device comprising a propulsion unit including a rotatably mounted propeller, and an engine drivingly connected to the propeller, and a cowl assembly enclosing the engine, the cowl assembly having an interior and including a bottom wall having therein an opening, and a chimney extending upwardly from the bottom wall for conducting air from the opening to the interior of the cowl assembly.

21 Claims, 6 Drawing Figures

MARINE PROPULSION DEVICE COWL ASSEMBLY

BACKGROUND OF THE INVENTION

The invention relates to marine propulsion device cowl assemblies and, more particularly, to inlet means in such cowl assemblies for admitting combustion air for the engine.

Marine propulsion device cowl assemblies typically include an air inlet for admitting combustion air for the engine. The inlet usually has a baffle or similar means for preventing water from entering the cowl assembly and wetting the engine. Many baffle arrangements are known in the art.

Attention is directed to the following U.S. patents which disclose such baffle arrangements:

| Inventors | U.S. Pat. No. | Issue Date |
|---|---|---|
| Pichl | 4,016,825 | Apr. 12, 1977 |
| Okazaki, et al. | 4,326,600 | Apr. 27, 1982 |
| Walsh | 4,348,194 | Sep. 7, 1982 |
| Takada, et al. | 4,379,702 | Apr. 12, 1983 |
| Kobayashi, et al. | 4,403,971 | Sep. 13, 1983 |
| Iwai | 4,493,661 | Jan. 15, 1985 |
| Okazaki | 4,522,602 | Jun. 11, 1985 |
| E. C. Kiekhaefer | 2,798,470 | July 9, 1957 |
| E. C. Kiekhaefer | 2,815,742 | Dec. 10, 1957 |
| D. A. Armstrong, et al. | 2,839,042 | June 17, 1955 |
| H. R. Johnson | 2,914,133 | Nov. 24, 1959 |
| R. C. Heidner | 3,195,530 | July 20, 1962 |
| L. Rubinowitz, et al. | 3,204,619 | Sept. 7, 1962 |
| L. P. Post, et al. | 3,358,668 | Dec. 19, 1967 |
| N. F. Brown, et al. | 3,557,902 | Jan. 26, 1971 |
| Swanson, et al. | 3,712,416 | Jan. 23, 1973 |
| N. J. Alexandrowicz | 3,610,198 | Oct. 5, 1971 |
| Yoshio Kawamura | 4,136,756 | Jan. 30, 1979 |

Attention is also directed to the following Japanese patents:

| | | |
|---|---|---|
| Makoto Kosugi | 57-26091 | Dec. 2, 1982 |
| Chikou Suzuki . | 57-41291 | Aug. 3, 1982 |

Attention is also directed to U.S. Dunham, et al. application Ser. No. 752,144, filed July 3, 1985, and titled "Outboard Motor Cowl Assembly," and to U.S. Ferguson application Ser. No. 593,285, filed Mar. 26, 1984, and titled "A Baffled Air Intake System for Outboard Motors."

SUMMARY OF THE INVENTION

The invention provides a marine propulsion device comprising a propulsion unit including a rotatably mounted propeller, and an engine drivingly connected to the propeller, and a cowl assembly enclosing the engine, the cowl assembly having an interior and including a bottom wall having therein an opening, and the cowl assembly also including chimney means extending upwardly from the bottom wall for conducting air from the opening to the interior of the cowl assembly, the chimney means including an upstream portion communicating with the opening and extending generally horizontally therefrom, and a generally vertical downstream portion communicating between the upstream portion and the interior.

In one embodiment, the upstream portion includes a wall portion directly above the opening.

In one embodiment, the cowl assembly further includes a rear wall, a first wall portion extending upwardly from the bottom wall and rearwardly above the opening, the first wall portion partially defining the upstream portion and having a rearward end located rearwardly of the opening, and a generally vertical second wall portion spaced from the rear wall and extending upwardly from the rearward end of the first wall portion, the second wall portion partially defining the downstream portion.

In one embodiment, the cowl assembly further includes opposite front and rear walls, the opening is located adjacent the rear wall, and the chimney means is located adjacent the rear wall and opens towards the front wall.

In one embodiment, the chimney means includes the rear wall.

In one embodiment, the cowl assembly further includes opposite side walls, and the chimney means further includes an inner wall extending upwardly from the bottom wall and between the side walls.

In one embodiment, the cowl assembly further includes a top wall, and the inner wall terminates in an upper edge spaced from the top wall.

In one embodiment, the chimney means further includes an upper wall extending forwardly from the rear wall and cooperating with the upper edge to define an opening into the interior.

In one embodiment, the rear wall has therein an inwardly extending recess having a bottom and defining a hand grip, and the upper wall defines the bottom of the recess.

In one embodiment, the bottom wall has therein a recess having therein the opening.

The invention also provides a cowl assembly as described above, and a cowl member which forms a portion of the cowl assembly described above.

The invention also provides a marine propulsion device comprising a propulsion unit including a rotatably mounted propeller, and an engine drivingly connected to the propeller, and a cowl assembly enclosing the engine, the cowl assembly having an interior and including a rear wall, a bottom wall having therein an opening adjacent the rear wall, and an inner wall extending upwardly from the bottom wall and having a portion generally parallel to and spaced from the rear wall, the inner wall cooperating with the rear wall to define a pair of opposed chimney walls for conducting air from the opening to the interior of the cowl assembly.

The invention also provides a cowl assembly as described immediately above, and a cowl member which forms a portion of the cowl assembly described immediately above.

A principal feature of the invention is the provision of chimney arrangements which are easy to manufacture because they are an integral part of the cowl assembly, yet which substantially prevent water (seawater and rainwater) from entering the cowl assembly both when the motor is tilted up and when the motor is in its normal operating position. Also, because the inlet opening is located at the bottom rear of the cowl assembly, any noise emitted thereform is directed downwardly toward the water rather than toward the operator. Furthermore, the inlet opening provides a convenient hand grip to aid in handling the marine propulsion device.

Other features and advantages of the invention will become apparent to those skilled in the art upon review of the following detailed description, claims, and drawings.

Figure 2:
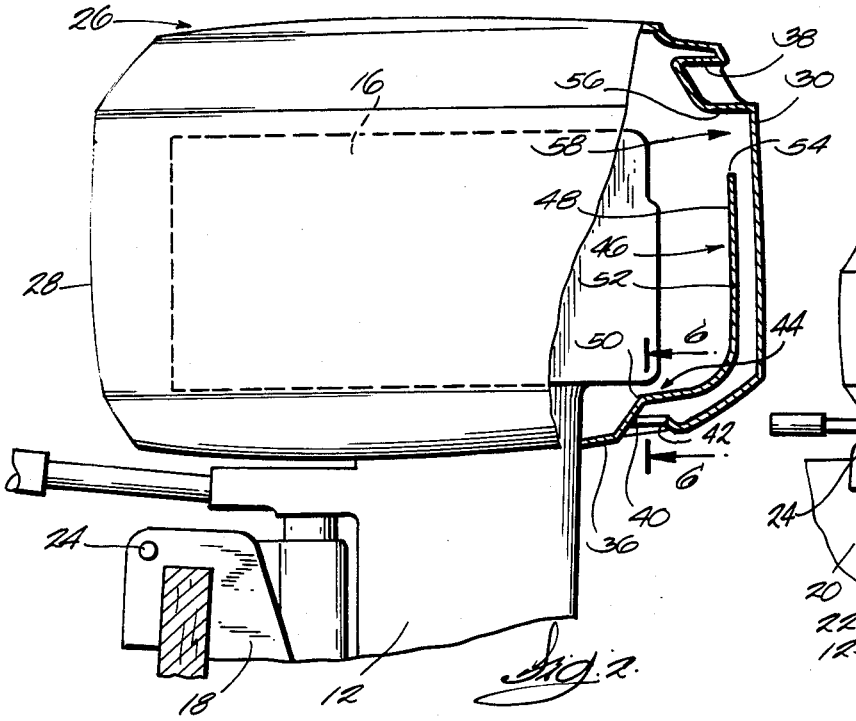
FIG. 2 is an enlarged view, partially in cross-section, of the cowl assembly included in the marine propulsion device shown in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 1:
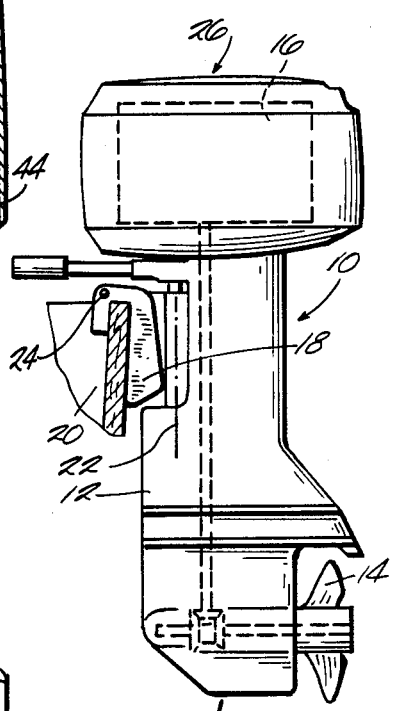
FIG. 1 is a side elevational view of a marine propulsion device which includes a cowl assembly and which embodies various of the features of the invention.

A marine propulsion device 10 embodying the invention is illustrated in the drawings. As best shown in FIG. 1, the marine propulsion device 10 is preferably an outboard motor and comprises a propulsion unit 12 including a rotatably mounted propeller 14, and an engine 16 drivingly connected to the propeller 14. The marine propulsion device 10 further comprises a mounting assembly 18 securing the propulsion unit 12 to the transom of a boat 20 for pivotal movement relative to the transom about a generally vertical steering axis 22, and about a generally horizontal tilt axis 24.

Figure 3:
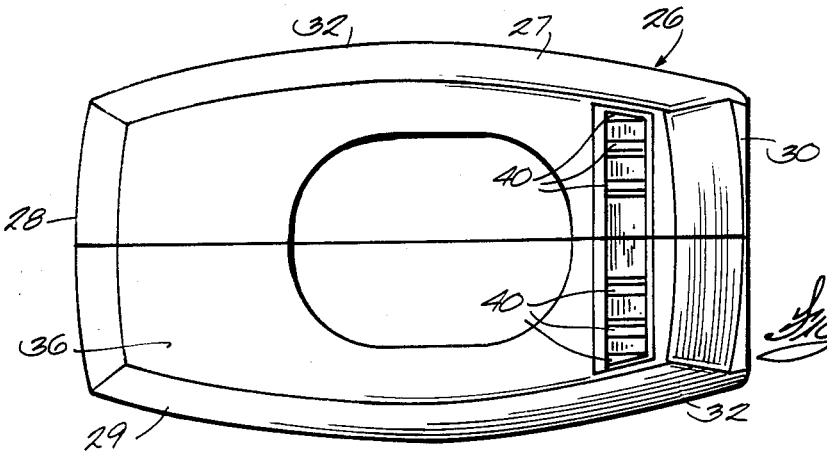
FIG. 3 is a bottom view of the cowl assembly shown in FIG. 2.

The marine propulsion device 10 further comprises a cowl assembly 26 enclosing the engine 16. In the illustrated construction, as best shown in FIG. 3, the cowl assembly 26 comprises two, generally symmetrical halves or members 27 and 29 split in the fore-aft direction. Such a construction is known in the art.

Figure 4:
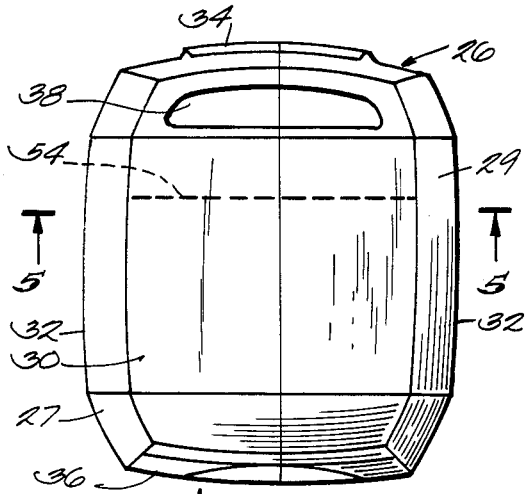
FIG. 4 is a rear view of the cowl assembly shown in FIG. 2.
Figure 5:
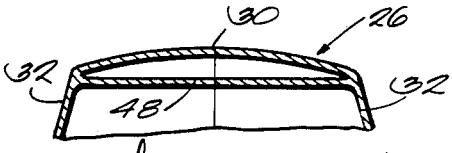
FIG. 5 is a cross-sectional view taken along line 5—5 in FIG. 4.
Figure 6:
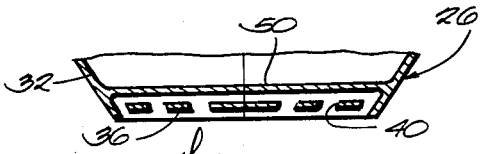
FIG. 6 is a cross-sectional view taken along line 6—6 in FIG. 2.

The cowl assembly 26 has an interior and includes opposite front and rear or fore and aft walls 28 and 30, respectively, opposite side walls 32, and opposite top and bottom walls 34 and 36, respectively. To facilitate handling of the marine propulsion device 10, and particularly to facilitate tilting of the propulsion unit 12 about the tilt axis 24, the rear wall 30 of the cowl assembly 26 has therein an inwardly extending recess 38 (FIGS. 2 and 4) which is located adjacent the top wall 34 and which defines a hand grip The bottom wall 36 has therein one or more air inlet openings 40 located adjacent the rear wall 30. The inlet openings 40 admit combustion air for the engine 16. In the preferred embodiment, as best shown in FIG. 2, the bottom wall 36 has therein a recess 42 having therein the inlet openings 40. Because the openings 40 are located in the recess 42, rain is substantially prevented from entering the inlet openings 40 when the propulsion unit 12 is tilted upwardly. The recess 42 and openings 40 also serve as a hand grip to aid in handling of the marine propulsion device 10. In the preferred embodiment, as best shown in FIG. 3, the recess 42 extends across substantially the entire width of the bottom wall 36.

The cowl assembly 26 further includes chimney means extending upwardly from the bottom wall 36 for conducting air from the air inlet openings 40 to the interior of the cowl assembly 26. While various suitable chimney means can be employed, in the preferred embodiment, the chimney means includes an upstream or lower portion 44 communicating with the openings 40 and extending generally horizontally therefrom, and a generally vertical downstream or upper portion 46 communicating between the upstream portion 44 and the interior of the cowl assembly 26. In the preferred embodiment, the upstream portion 44 also extends rearwardly from the air inlet openings 40.

Preferably, the chimney means is located adjacent the rear wall 30 and includes the rear wall 30, and an inner wall 48 extending upwardly from the bottom wall 36 and between or inwardly from the side walls 32. The inner wall 48 is integrally connected to the side walls 32 and to the bottom wall 36. The inner wall 48 includes a first wall portion 50 extending upwardly from the bottom wall 36 and rearwardly above the openings 40, the first wall portion 50 having a rearward end located rearwardly of the inlet openings 40, and a generally vertical second wall portion 52 spaced from the rear wall 30 and extending upwardly from the rearward end of the first wall portion 50. The first wall portion 50 cooperates with the bottom wall 36 to define the upstream portion 44, and the second wall portion 52 cooperates with the rear wall 30 to define the downstream portion 46 of the chimney means. In other words, the inner wall 48 cooperates with the rear wall 30 and with the bottom wall 36 to define a pair of opposed chimney walls for conducting air from the inlet openings 40 to the interior of the cowl assembly 26.

It should be understood that while in the illustrated construction the first wall portion 50 includes a first segment extending upwardly and rearwardly at an angle of approximately 60° from horizontal, and a second, generally horizontal segment extending rearwardly from the first segment, the first wall portion 50 can have various other constructions. For example, the first wall portion 50 can include a single, straight wall segment extending upwardly and rearwardly, or the first wall portion 50 can be curved.

Preferably, the inner wall 48 (specifically the second wall portion 52) terminates in an upper edge 54 (FIGS. 2 and 4) spaced from the top wall 34 of the cowl assembly 26. Furthermore, in the preferred embodiment, the chimney means includes an upper wall 56 (FIG. 2) extending forwardly from the rear wall 30 and cooperating with upper edge 54 to define an opening 58 into the interior of the cowl assembly 26, so that the chimney means opens toward the front wall 28 of the cowl assembly 26, or toward the engine 16. In the illustrated construction, the upper wall 56 defines the bottom of the recess 38.

Thus, the inner wall 48, the bottom wall 36, the rear wall 30, the upper wall 56, and the side walls 32 define a chimney for conducting air from the inlet openings 40 to the interior of the cowl assembly 26.

The chimney operates as follows. Combustion air for the engine 16 is drawn into the interior of the cowl assembly 26 through the air inlet openings 40 and the chimney. Most of the water that enters the air inlet openings 40 will impinge upon the first wall portion 50 and will run back out through the air inlet openings 40. Water that reaches the generally vertical downstream portion 46 of the chimney will impinge upon the upper wall 56 and will run back out of the chimney while the air is turned forwardly by the upper wall 56 and is directed toward the engine 16.

Various features and advantages of the invention are set forth in the following claims.

We claim:

1. A marine propulsion device comprising a propulsion unit including a rotatably mounted propeller, and an engine drivingly connected to said propeller, and a cowl assembly enclosing said engine and defining a free space located between said cowl assembly and said engine and generally surrounding said engine, said cowl assembly including a bottom wall having therein an opening, and said cowl assembly also including chimney means extending upwardly from said bottom wall for conducting air from said opening to said free space in said cowl assembly, said chimney means including an upstream portion communicating with said opening and extending generally horizontally therefrom, and a generally vertical downstream portion communicating between said upstream portion and said free space.

2. A marine propulsion device as set forth in claim 1 wherein said upstream portion includes a wall portion directly above said opening.

3. A marine propulsion device as set forth in claim 1 wherein said cowl assembly further includes opposite front and rear walls, wherein said opening is located adjacent said rear wall, and wherein said chimney means is located adjacent said rear wall and opens towards said front wall.

4. A marine propulsion device as set forth in claim 1 wherein said cowl assembly includes a rear wall, and wherein said chimney means includes said rear wall.

5. A marine propulsion device as set forth in claim 4 wherein said cowl assembly further includes opposite side walls, and wherein said chimney means further includes an inner wall extending upwardly from said bottom wall and between said side walls.

6. A marine propulsion device as set forth in claim 5 wherein said cowl assembly further includes a top wall, and wherein said inner wall terminates in an upper edge spaced from said top wall.

7. A marine propulsion device as set forth in claim 6 wherein said chimney means further includes an upper wall extending forwardly from said rear wall and cooperating with said upper edge to define an opening into said free space.

8. A marine propulsion device as set forth in claim 7 wherein said rear wall has therein an inwardly extending recess having a bottom and defining a hand grip, and wherein said upper wall defines said bottom of said recess.

9. A marine propulsion device as set forth in claim 1 wherein said bottom wall has therein a recess having therein said opening.

10. A marine propulsion device comprising a propulsion unit including a rotatably mounted propeller, and an engine drivingly connected to said propeller, and a cowl assembly enclosing said engine, said cowl assembly having an interior and including a rear wall, a bottom wall having therein an opening adjacent said rear wall, and an inner wall extending upwardly from said bottom wall and having a portion generally parallel to and spaced from said rear wall, said inner wall cooperating with said rear wall to define a pair of opposed chimney walls for conducting air from said opening to said interior of said cowl assembly.

11. A marine propulsion device as set forth in claim 10 wherein said cowl assembly further includes opposite side walls, and wherein said inner wall extends between said side walls.

12. A marine propulsion device as set forth in claim 10 wherein said cowl assembly further includes a top wall, and wherein said inner wall terminates in an upper edge spaced from said top wall.

13. A marine propulsion device as set forth in claim 12 wherein said cowl assembly further includes an upper wall extending forwardly from said rear wall and cooperating with said upper edge to define an opening into said interior.

14. A marine propulsion device as set forth in claim 13 therein said rear wall has therein an inwardly extending recess having a bottom and defining a hand grip, and wherein said upper wall defines said bottom of said recess.

15. A marine propulsion device as set forth in claim 10 wherein said bottom wall has therein a recess having therein said opening.

16. A marine propulsion device comprising a propulsion unit including a rotatably mounted propeller, and an engine drivingly connected to said propeller, and a cowl assembly enclosing said engine, said cowl assembly having an interior and including a bottom wall having therein an opening, and a rear wall, and said cowl assembly also including chimney means extending upwardly from said bottom wall for conducting air from said opening to said interior of said cowl assembly, said chimney means including an upstream portion communicating with said opening and extending generally horizontally therefrom, and a generally vertical downstream portion communicating between said upstream portion and said interior, and said chimney means also including a first wall portion extending upwardly from said bottom wall and rearwardly above said opening, said first wall portion partially defining said upstream portion and having a rearward end located rearwardly of said opening, and a generally vertical second wall portion spaced from said rear wall and extending upwardly from said rearward end of said first wall portion, said second wall portion partially defining said downstream portion.

17. A marine propulsion device including a propulsion unit including a rotatably mounted propeller, and an engine drivingly connected to said propeller, and a cowl assembly enclosing said engine, said cowl assembly having an interior and including a top wall, a front wall, a rear wall having therein, adjacent said top wall, an inwardly extending first recess having a bottom and defining a hand grip, opposite said walls, a bottom wall having therein a second recess adjacent said rear wall, said second recess having therein an opening, an inner wall extending between said side walls, said inner wall including a first wall portion extending upwardly from said bottom wall and rearwardly above said opening, and a generally vertical second wall portion extending upwardly from said first wall portion and being generally parallel to and spaced from said rear wall, said second wall portion terminating in an upper edge spaced from said top wall, and an upper wall defining said bottom of said first recess and extending forwardly from said rear wall and above said upper edge, with said inner wall, said rear wall, said upper wall, and said side walls defining a chimney for conducting air from said opening to said interior of said cowl assembly.

18. A cowl assembly for an outboard motor including an internal combustion engine, said cowl assembly being adapted to enclose the engine, defining a free space located between said cowl assembly and the engine and generally surrounding the engine, and comprising a bottom wall having therein an opening, and chimney means extending upwardly from said bottom wall for conducting air from said opening to said free space in said cowl assembly, said chimney means including an upstream portion communicating with said opening and extending generally horizontally therefrom, and a generally vertical downstream portion communicating between said upstream portion and said free space.

19. A cowl assembly for an outboard motor, said cowl assembly having an interior and comprising a rear wall, a bottom wall having therein an opening adjacent said rear wall, and an inner wall extending upwardly from said bottom wall and having a portion generally parallel to and spaced from said rear wall, said inner wall cooperating with said rear wall to define a pair of opposed chimney walls for conducting air from said opening to said interior of said cowl assembly.

20. A cowl member for an outboard motor including an internal combustion engine, said cowl member being adapted to enclose the engine, defining a free space located between said cowl assembly and the engine and generally surrounding the engine, and comprising a bottom wall having therein an opening, and chimney means extending upwardly from said bottom wall for conducting air from said opening to said free space in said cowl assembly, said chimney means including an upstream portion communications with said opening and extending generally horizontally therefrom, and a generally vertical downstream portion communicating between said upstream portion and said free space.

21. A cowl member for an outboard motor, said cowl member having an interior and comprising a rear wall, a bottom wall having therein an opening adjacent said rear wall, and an inner wall extending upwardly from said bottom wall and having a portion generally parallel to and spaced from said rear wall, said inner wall cooperating with said rear wall to define a pair of opposed chimney walls for conducting air from said opening to said interior of said cowl assembly.

* * * * *